US006715149B2

(12) United States Patent
Myerscough

(10) Patent No.: US 6,715,149 B2
(45) Date of Patent: Apr. 6, 2004

(54) CAPTIVE SHELL DRY-SUIT

(75) Inventor: Richard Kerr Myerscough, Victoria (CA)

(73) Assignee: Whites Manufacturing Ltd., Saanichton (CA)

( * ) Notice: Subject to any disclaimer, the term of this patent is extended or adjusted under 35 U.S.C. 154(b) by 156 days.

(21) Appl. No.: 10/025,627

(22) Filed: Dec. 26, 2001

(65) Prior Publication Data

US 2003/0115653 A1 Jun. 26, 2003

(51) Int. Cl.[7] ..... B63C 11/04
(52) U.S. Cl. ..... 2/2.15; 2/82
(58) Field of Search ..... 2/2.15, 2.16, 82, 2/79, 69, 227, DIG. 5, 275

(56) References Cited

U.S. PATENT DOCUMENTS 209,413 A * 10/1878 Moses ..... 2/269
3,665,517 A * 5/1972 Hyman ..... 2/84
4,293,957 A 10/1981 Melarvie ..... 2/2.1 R
4,741,050 A * 5/1988 O'Kane et al. ..... 112/413
5,978,960 A * 11/1999 Wrightman ..... 2/2.15
6,415,449 B2 * 7/2002 Duplock ..... 2/275

* cited by examiner

*Primary Examiner*—Tejash Patel
(74) *Attorney, Agent, or Firm*—Oyen Wiggs Green & Mutala

(57) ABSTRACT

This invention relates to a novel design of dry-suit. More particularly, this invention pertains to a novel dry-suit design which has a smooth captive shell and concealed pleats for improved dry-suit functionality. A dry-suit comprising: (a) a hollow element-proof fabric formed in the shape of a human body including two arms, two legs and a torso; (b) first and second inwardly extending pleats formed in each of the two legs; and (c) first and second elastic element-proof fabric panels covering the respective first and second pleats and sealed around the periphery with the surrounding adjacent regions of the element-proof fabric of the dry-suit.

11 Claims, 5 Drawing Sheets

CAPTIVE SHELL DRY-SUIT

FIELD OF THE INVENTION

This invention relates to a novel design of dry-suit. More particularly, this invention pertains to a novel design of dry-suit which has a smooth captive shell and concealed pleats for improved dry-suit functionality.

BACKGROUND

Fabric-based underwater diving dry-suits have been manufactured by the basic processes of heat seaming and stitching over several decades. To provide the user with ease of motion and the ability to access and remove the suits under severe conditions, dry-suits have traditionally been made from bulky fabric of an area quantity which is well in excess of the area required to cover the body of the user. All sealing of the seams of the dry-suit is typically done on the exterior panels of the suit. Because excess fabric is used, the excess fabric, when the dry suit is worn by a diver, tends to collect and crease at the flex points of the dry-suit such as the shoulders, armpits, neck, waist, knees and crotch areas of the dry-suit. This causes discomfort to the wearer of the dry-suit, especially at greater water depths where the hydrostatic water pressure forces the folds and creases against the body of the wearer at the respective flex points. The accumulation of excess fabric at critical points can also create a safety hazard because the excess fabric can interfere with equipment used by the diver.

Melarvie (U.S. Pat. No. 4,293,957, granted 1980) discloses a system for wetsuits using a stretchable panel underlaid by a single attached flap to allow ease of entry and exit of the wearer into and out of the wetsuit while retaining some motion flexibility. Wetsuits are distinct from dry-suits and permit water to enter the space between the wetsuit and the wearer's body. A dry-suit keeps the wearer's body dry. Design considerations for wetsuits and dry-suits are different.

SUMMARY OF INVENTION

The subject invention discloses a novel design of an underwater dry-suit and a method of fabricating the diving dry-suit, and other dry-suits, that provides a contiguously sealed dry-suit with inner pleats and outer closure panels located at neutral non-flex point areas of the dry-suit. The method comprises applying the interior pleats and outer closure panels to designated areas of the dry-suit to thereby provide the suit with self-restraining non-creep capability.

Applying the internal pleats and outer closure panels to designated non-critical neutral areas of the dry-suit provides a controlled internal gap between the dry-suit and the wearer which enables the wearer to optimally select and use undergarments for the several purposes of insulation, comfort, safety, storage, or any other specific or combined function (s). Locating the pleats and outer closure panels at neutral non-flex areas of the dry-suits provides for controlled smooth appearance of the outer garment. The use of internal pleats and panels at neutral areas of the dry-suit not only provides sealing from the elements but also controls specific noise signatures of the dry-suit while in different operating modes in water.

The invention is directed to a dry-suit comprising: (a) a hollow element-proof fabric formed in the shape of a human body including two arms, two legs and a torso; (b) first and second inwardly extending pleats formed in each of the two legs; and (c) first and second elastic element-proof fabric panels covering the respective first and second pleats and sealed around the periphery with the surrounding adjacent regions of the element-proof fabric of the dry-suit.

The element-proof fabric can be waterproof fabric. The dry-suit can include one or more horizontal inwardly extending pleats formed in the rear waist region of the torso of the dry-suit and a waterproof fabric panel covering the horizontal waist pleat area and sealed to the surrounding adjacent regions of the waist area of the torso of the dry-suit.

The dry-suit can include pleats formed in the calf areas of the two legs of the dry-suit, the shoulder regions and the neck area of the torso of the dry-suit, and respective fabric panels formed of waterproof fabric covering the respective pleats in the calf areas of the two legs, the two shoulder regions and the neck area, and being sealed to the surrounding adjacent regions of the respective legs, shoulders or neck of the dry-suit.

The invention is also directed to a military suit comprising: (a) a hollow element-proof fabric formed in the shape of a human body including two arms, two legs and a torso; (b) pleats formed in each of the thigh areas of the two legs; and (c) elastic element-proof fabric panels covering the respective pleats and sealed with the surrounding adjacent thigh regions of the fabric of the military suit.

The military suit can include pleats formed in the rear waist region of the torso of the military suit and an element-proof fabric panel covering the waist pleat area and sealed to the surrounding adjacent regions of the waist area of the torso of the military suit.

The invention also pertains to a dry-suit comprising: (a) a hollow waterproof fabric formed in the shape of a human body including two arms, two legs and a torso; (b) first and second horizontal pleats extending inwardly along the front regions of each of the two legs of the dry-suit; and (c) first and second elastic waterproof fabric panels covering the respective first and second horizontal pleats and sealed with the surrounding adjacent regions of the fabric of the dry-suit.

Horizontal pleats can be located in the back region of the torso of the dry-suit or in the rear surfaces of the two legs of the dry-suit.

The invention also pertains to a dry-suit comprising: (a) a hollow waterproof fabric formed in the shape of a human body including two arms, two legs and a torso; (b) first and second vertical pleats extending inwardly along the front regions of each of the two legs of the dry-suit; and (c) first and second elastic waterproof fabric panels covering the respective first and second vertical pleats and sealed with the surrounding adjacent regions of the fabric of the dry-suit.

Vertical pleats can be located in the back region of the torso of the dry-suit or in the rear surfaces of the two legs of the dry-suit. The dry-suit can include vertical pleats and covering panels.

BRIEF DESCRIPTION OF DRAWINGS

In drawings which illustrate specific embodiments of the invention, but which should not be construed as restricting the spirit or scope of the invention in any way:

FIG. 5 illustrates a partial side cut-away view of the torso and leg of a crouching person wearing a military suit according to the invention.

DETAILED DESCRIPTION OF SPECIFIC EMBODIMENTS OF THE INVENTION

Figure 1:
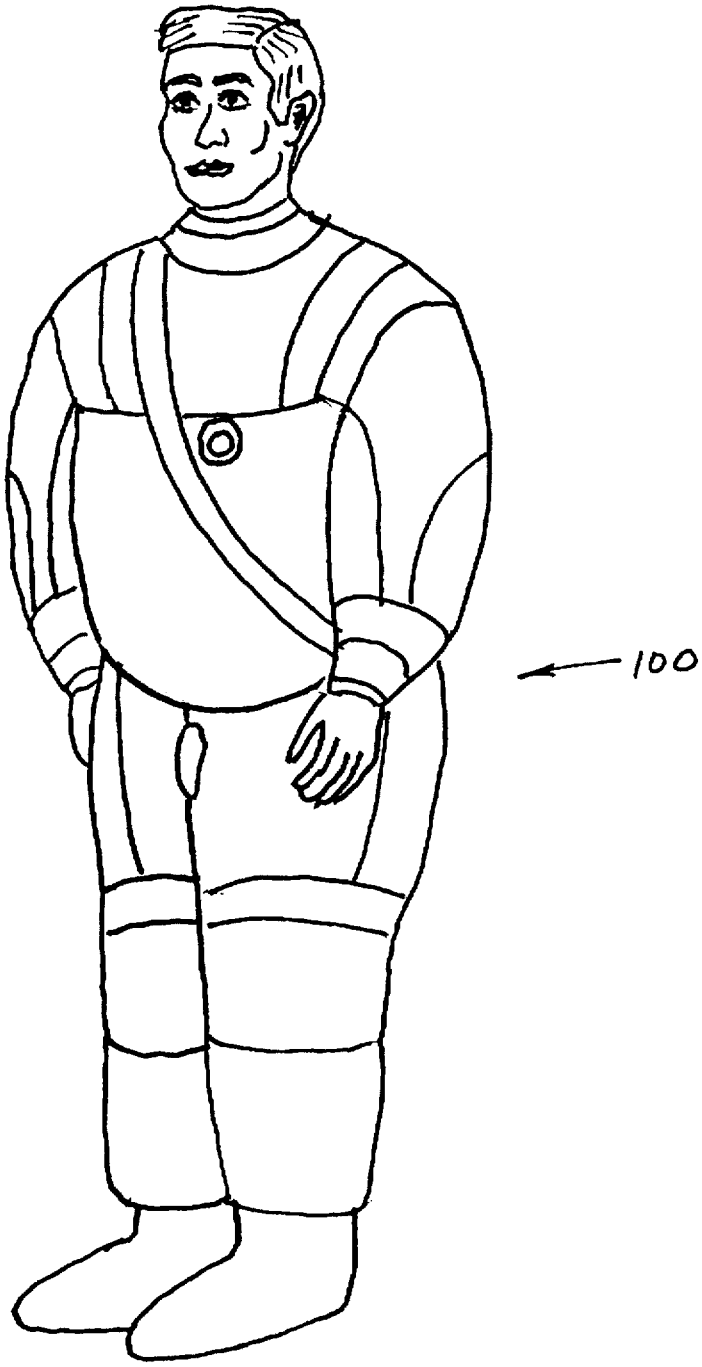
FIG. 1 illustrates an isometric frontal view of a dry-suit according to the invention worn by a diver.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

In endeavouring to resolve the problems associated with the bulk and excess of waterproof fabric used in a typical dry-suit, and provide a dry-suit that does not collect folds and creases in flex areas and other problem areas of the dry-suit (defined herein as critical areas) and make the dry-suit safer and more comfortable for the commercial and recreational cold-water diver, it has been noted that none of the prior art incorporates or has conceived of a dry-suit system that allows internal sealing with a streamlined, captive smooth outer shell approach. The dry-suit construction approach according to the invention herein is inherently different from conventional dry-suit constructions. This is because it is completely sealed utilizing at non-critical areas (defined herein as neutral areas) internal pleats and covering panels which permit the dry-suit to retain clothing-like comfort characteristics. The dry-suit according to the invention is disposed away from the user's body, thereby providing the capability of conveniently using additional layers of insulated gear underneath the dry-suit and next to the user's body. Furthermore, the gathering of excess outer fabric in non-critical areas (neutral areas) covered by outer smooth panels serves to restrain the excess fabric from gathering in the critical flex-areas of the wearer's body and thus interfering with the comfortable wear and the functionality of the suit.

Several embodiments of the invention are described herein and illustrated in the drawings. However, it is understood that the subject invention is not restricted to individual areas of a dry-suit as shown in the drawings, and may be applied over larger or smaller areas of the dry-suit, including the suit as a whole, in appropriate circumstances. It is additionally understood that the subject invention may be applied without restraint not only to diving dry-suits, but also to other types of dry-suits that require a seal from the elements. As such, the invention is not restricted to those applications described herein, but is to include any and all similar applications as envisioned by practitioners in the field.

Referring to the drawings, FIG. 1 illustrates an isometric frontal view of a dry-suit 100 according to the invention worn by a diver. The dry-suit 100 has a smooth integral outer appearance. As can be seen, the dry-suit according to the invention provides an attractive continuous smooth outer surface that is sealed from entry of water or in the case of dry-suits used for other purposes, sealed from the applicable elements. The smooth continuous outer surface hides the pleats (not visible) that are gathered internally in non-critical neutral areas of the dry-suit thereby enabling ready movement and comfortable use of the dry-suit by the wearer.

Figure 2:
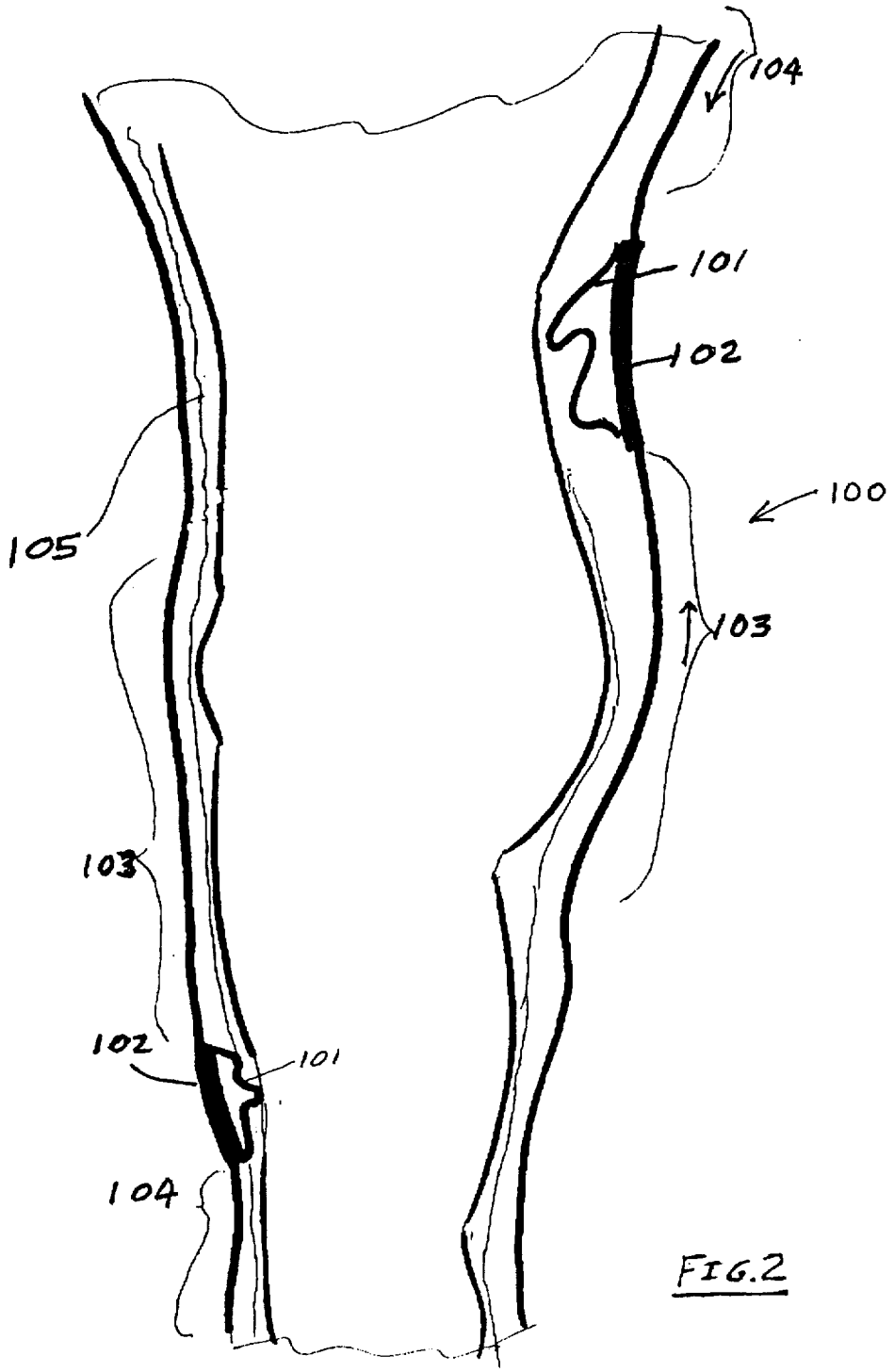
FIG. 2 illustrates a side cut-away view of the lower torso and thigh of a person wearing a dry-suit according to the invention, with pleats and overlying outer panels at the rear waist and front knee areas of the wearer.

FIG. 2 illustrates a side cut-away view of the torso and thigh of a person wearing a dry-suit according to the invention, with internal pleats and overlying panels at the rear waist and front knee areas of the person. In particular, FIG. 2 provides a cut-away view of the suit 100 and illustrates two of the areas that are pertinent to the problem in conventional dry-suits of gathering of excess fabric at critical flex-point areas of the dry-suit, namely the waist and knee areas of the dry-suit.

Referring to FIG. 2, the internal pleats 101 are an inherent and integral part of the dry-suit and are contiguous with the impervious fabric that provides the seal from water intrusion into the dry-suit. The pleats 101 are covered by elasticized, reinforced overlay panels 102 which are sealed around the periphery of the pleats 101 and provide a smooth outer appearance to the dry-suit. This combination of internal pleats 101 and flexible overlay panels 102 allows the dry-suit material to be drawn more tightly on the body of the wearer at designated neutral locations, and prevents excess fabric from gathering at any critical interference or flex-point areas on the body of the user. It also prevents interference of the suit with tools and other devices that are attached to or in proximity to the user of the dry-suit.

Specifically, the internal pleats 101 and overlay panels 102 are located on areas of the dry-suit which provide maximum benefit to the user by gathering excess waterproof fabric as internal pleats 101 above and below the critical areas of the dry-suit. FIG. 2 shows the critical areas as 103 and 104. (Such critical areas are the waist, knees, crotch, shoulders, armpits and neck of the dry-suit. The subject invention, by moving the excess fabric as internal pleats 101 to neutral noncritical areas of the dry-suit, overcomes this problem.)

In the wetsuit invention of Melarvie, U.S. Pat. No. 4,293,957 referenced above, it is the function of the outer stretch panel to simply provide a stretch capability to the wetsuit and thereby accommodate different size wetsuit users. Wetsuits are significantly different from dry-suits and have different design criteria. Wetsuits permit water to enter the wetsuit and lodge adjacent to the skin of the wearer. Dry-suits are designed to keep water outside the dry-suit and away from the body of the wearer. Dry-suits must seal against the entry of water and because insulating underwear can be worn, enable divers to remain in cold water for longer periods of time than is possible for wetsuit users.

A second objective of Melarvie is to provide a flap which is internal to the suit and attached to one side of a slit opening. In this way, the function of a wetsuit, which is to trap a thin insulating layer of water between the user and the wetsuit material, is retained. The trapped water is warmed to the user's skin temperature and provides an insulating warm layer between the thick fabric of the wetsuit and the body of the user.

In the subject invention, it is mandatory, for water sealing purposes, for the dry-suit to provide an internal contiguous pleats 101, and elastic overlay sealing panels 102. The internal pleats 101 and the covering sealing panels 102 allow the fabric of the dry-suit above and below the critical areas to remain relatively free of the user's body. The elastic overlay sealing panels 102 are designed so that the dry-suit fabric which, by reason of the appropriate placement of the internal pleats 101 and overlay sealing panels 102, will necessarily have some inherent elastic restraint and conform to fit the user's body. Smooth placement of the dry-suit fabric at critical comfort and non-interference neutral areas, as embodied in the drawings at 103 and 104 (see FIG. 2), is thus accomplished, thereby providing maximum performance benefit to the user.

A critical and beneficial aspect of the subject invention is that the dry-suit design retains and even enhances the ability of the user to wear one or more garments underneath the dry-suit, such as thermal underwear, and the like, to thereby insulate the user from cold water conditions. The overlay sealing panels 102 and internal pleats 101 are designed to cause the dry-suit fabric to gap naturally and outwardly from the user's body and provide the internal space necessary to install warm under garments such as 105 (shown in FIG. 2), between the dry-suit and the user's body. The invention therefore provides for garments to fit underneath the dry-suit and be freely worn against the user's body, with no consequential compression or restriction from the dry-suit at critical points. This provides maximum insulating value to the wearer of the dry-suit. Hydrostatic compression of a conventional dry-suit, without the overlay panels and internal pleats, against the undergarments of the user, inherently crushes and reduces the insulating value of the underlying garments due to closer proximity of the external cold water layer to the wearer's body.

In use, dry-suits are typically pressure balanced by providing for the inlet and venting of compressed air. As the user descends in a water body, air within the dry-suit next to the wearer's body is compressed by the hydrostatic pressure, and the dry-suit naturally tends to be forced against the body of the user. This compression force not only reduces insulating value but it also causes typical dry-suits with excess fabric to creep and become bunched up in uncomfortable and sometimes unsafe areas (termed critical areas herein) against the user and the user's attached and peripheral equipment such as air tanks and the like.

Conversely, as the user ascends from depth in the water body, the air within the dry-suit expands and must be vented externally to prevent the dry-suit from over-inflating. With a conventional dry-suit, this expanded air generally will attempt to rise within the dry-suit and be held around the uppermost portion of the user's body. This causes the excess fabric of the conventional dry-suit to become lifted and collect around the upper body of the user. In turn, the lower parts of the dry-suit are pulled, pinched and compressed against the lower extremities of the diver, such as the legs and the crotch area. The result is that a reduced insulation phenomenon is created in the lower regions of the dry-suit, while the bunched fabric collects in the upper area of the wearer. Bunching of fabric in the upper area is not only uncomfortable and awkward but it can lead to potential interference with the user's attached and peripheral equipment such as scuba gear. This can lead to a potentially hazardous situation for the diver.

The internal pleats and overlay sealing panels of the subject invention and their location at neutral dry-suit areas aids in preventing fabric movement and bunching of the dry-suit on the wearer. This provides an enhanced safety feature as well as improved comfort for dry-suit users.

Figure 3:
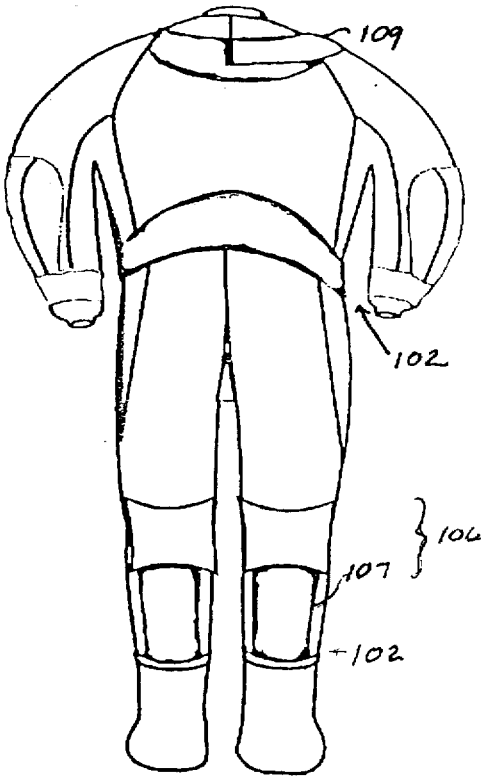
FIG. 3 illustrates a rear view of a dry-suit according to one embodiment of the invention.
Figure 4:
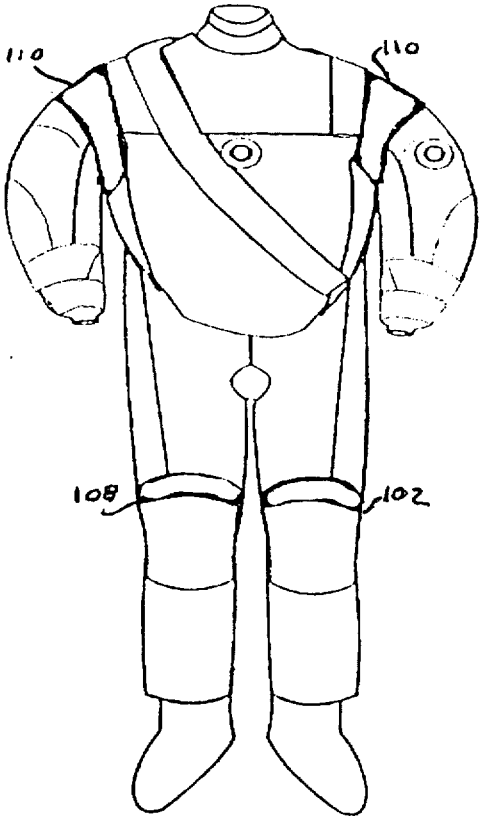
FIG. 4 illustrates a front view of a dry-suit according to one embodiment of the invention.

FIG. 3 illustrates a rear view of a dry-suit according to one embodiment of the invention with horizontal internal pleats and overlay panels. FIG. 4 illustrates a front view of a dry-suit according to one embodiment of the invention with horizontal internal pleats and panels.

While the rear waist and front upper knee areas of the dry-suit as shown in FIG. 2 are prime neutral areas, FIGS. 3 and 4 indicate other potential areas for application of the invention, namely the neck, waist and calf areas of the dry-suit (FIG. 3) and the shoulder and thigh areas of the dry-suit (FIG. 4).

An example of suitable location of the neutral pleats 101 and overlay sealing panels 102 is illustrated in FIG. 3. Location of the panel(s) and pleat(s) 107 below location 106 provides a restraint against upward creep and movement of the dry-suit fabric to the critical rear knee areas of the wearer. Similarly, internal pleats and overlay panels provided above the front knees at location 108 of FIG. 4 restrain movement, in this case, downward movement of the dry-suit fabric on the legs of the diver. Similar balanced features for locations of the internal pleats and overlay panels are provided at other areas of the suit, such as at the rear waist 102 and rear neck 109 (see FIG. 3) and front shoulders 110 (FIG. 4) of the dry-suit. Thus, enhanced safety is achieved by the restraint of fabric in normal dive operating situations, and especially the restraint of fabric in unusual situations, such as inverted ascent from depth. In this case, it is apparent to one skilled in the art, that the restraint of bulk dry-suit fabric movement on the user's body allows the user to recover to a natural upright position, without encountering interference of the fabric around external and attached equipment, such as air tanks.

It is a further object of the invention to provide a suit with added flexibility around the key areas of the dry-suit for entry and exit of the wearer, while at the same time retaining the waterproof qualities discussed above. The neck panel 109 shown in FIG. 3, for example, permits the user to flex the dry-suit around the upper zipper area of the dry-suit. This eases putting on and removal of the dry-suit by the wearer. The invention also permits designers of dry-suits freedom in location of the zipper on the dry-suit without having to provide additional bulk fabric to accommodate wearer entry and exit criteria, while at the same time retaining a streamlined dry-suit form. The panel 109 in the neck (FIG. 3) in conjunction with similarly strategically placed internal pleat and overlay panel designs enhances wearer entry and exit from the suit while at the same time having substantial gear located on the body and undergarments, all of which are an obvious benefit to military and scientific applications.

Figure 5:
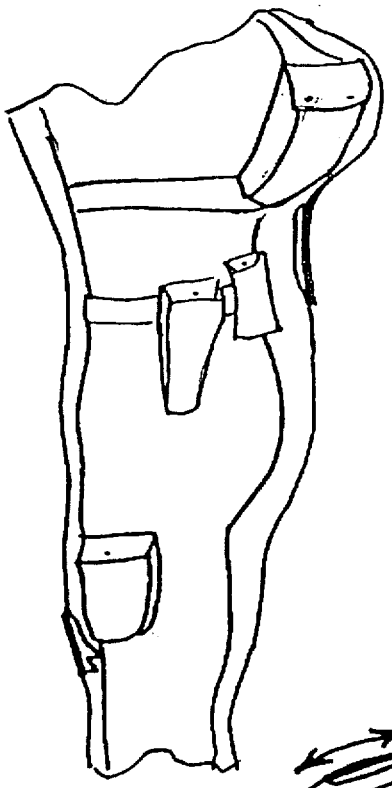
FIG. 5 illustrates a partial side cut-away view of the torso and thigh of a person wearing a military suit according to the invention.
Figure 6:
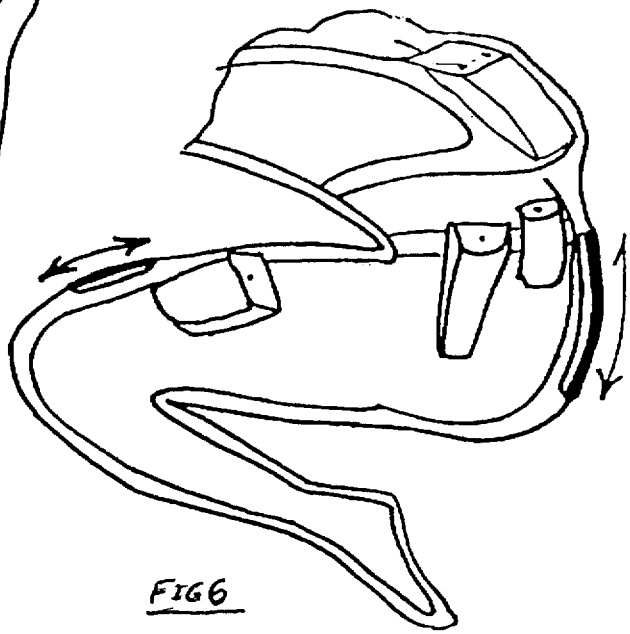

It is a further object of the subject invention to provide to designers of dry-suits the capability to tailor specific areas of the dry-suit or other garments for internal functions. FIGS. 5 and 6 illustrate a military suit with the capability of providing an expandable area to allow storage of communication devices or other devices in the dry-suit. Any such devices may be accommodated by providing specific adaptation and location of the internal pleats and overlay panels to specific critical areas, such as the knee, buttocks and small of the back waist of the wearer.

It is yet a further object of the subject invention to provide capacity to the user of the dry-suit to have control over the total apparent external volume of the dry-suit, both with and without any devices that the user may wish to store underneath the garment. This is of specific benefit to a marine mammal science user who may wish to control, for example, the appearance or noise signature in water of his dry-suit, with and without devices. In conventional dry-suits, the uncontrolled excess of fabric of the dry-suit has a tendency to rub together and create in water an undesirable interference noise which is detected by the acute hearing of marine mammals. This can be problematic. In a typical embodiment, a military suit as shown in FIGS. 5 and 6 controls the disposition and amount of excess fabric materials that are necessary for storage of various devices. This reduces greatly the amount of noise signature the dry-suit wearer generates while moving about in the water. When the internal pleats and overlay sealing panels according to the invention are not present, the fabric materials normally flap and scrape, thereby creating unwanted noise in the water.

Figure 7:
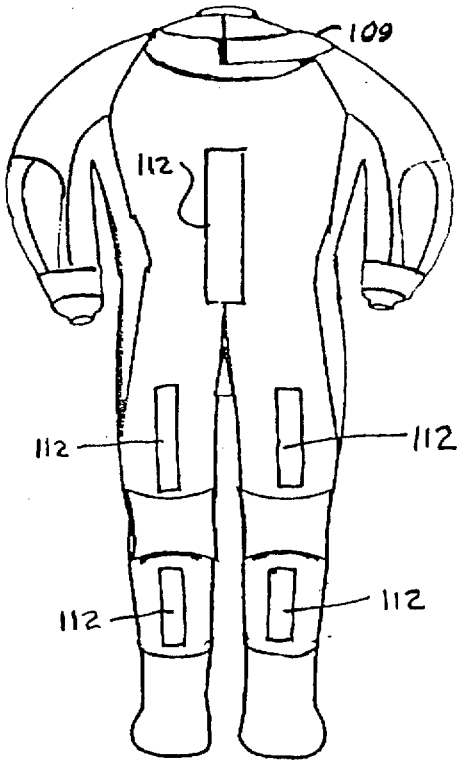
FIG. 7 illustrates a rear view of a dry-suit according to a second embodiment of the invention.
Figure 8:
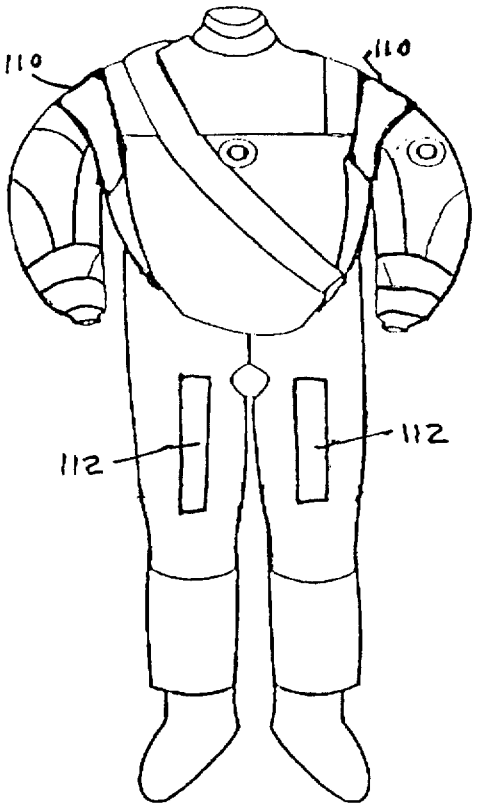
FIG. 8 illustrates a front view of a dry-suit according to a second embodiment of the invention.

FIG. 7 illustrates a rear view of a dry-suit according to a further embodiment of the invention. FIG. 8 illustrates a front view of a dry-suit according to the further embodiment of the invention. As seen in FIGS. 7 and 8, the dry-suit can be equipped with vertical internal pleats and overlay panels 112 on one or more of the arms, legs and torso of the dry-suit, front and/or back. In some cases, vertical pleats and panels 112 may be preferred for certain applications, and to allow certain movements which cannot be as easily accomplished with horizontal pleats and panels. Nonetheless, the basic principle is the same, namely to prevent bunching of excess fabric at critical positions of the dry-suit and the wearer's body and to increase comfort. A combination of vertical pleats and panels, and horizontal pleats and panels, can also be used and may be advantageous in certain applications.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A dry-suit comprising:

(a) a hollow element-proof fabric formed in the shape of a human body including two arms, two legs and a torso;

(b) first and second inwardly extending pleats formed in each of the two legs;

(c) first and second elastic element-proof fabric panels covering the respective first and second pleats and sealed around the periphery with the surrounding adjacent regions of the element-proof fabric of the dry-suit; and (d) one or more horizontal inwardly extending pleats formed in the rear waist region of the torso of the dry-suit and a waterproof fabric panel covering the horizontal waist area and sealed to the surrounding adjacent regions of the waist area of the torso of the dry suit.

2. A dry-suit as claimed in claim 1 wherein the element-proof fabric is waterproof fabric.

3. A dry-suit as claimed in claim 2 including pleats formed in the calf areas of the two legs of the dry-suit, and respective fabric panels formed of waterproof fabric covering the respective pleats in the calf areas of the two legs and being sealed to the surrounding adjacent regions of the respective legs of the dry-suit.

4. A dry-suit as claimed in claim 2 including pleats formed in the two shoulder regions of the torso of the dry-suit, and respective fabric panels formed of waterproof fabric covering the respective pleats in the two shoulder regions and being sealed to the surrounding adjacent regions of the respective shoulders of the dry-suit.

5. A dry-suit as claimed in claim 2 including horizontal pleats formed in the neck area of the torso of the dry-suit and a waterproof fabric panel covering the neck area of the dry-suit and sealed to the surrounding adjacent areas of the neck area of the dry-suit.

6. A military suit comprising:

(a) a hollow element-proof fabric formed in the shape of a human body including two arms, two legs and a torso;

(b) pleats formed in each of the thigh areas of the two legs;

(c) elastic element-proof fabric panels covering the respective pleats and sealed with the surrounding adjacent thigh regions of the fabric of the military suit; and (d) pleats formed in the rear waist region of the torso of the military suit and an element-proof fabric panel covering the waist pleat area and sealed to the surrounding adjacent regions of the waist area of the torso of the military suit.

7. A dry-suit comprising:

(a) a hollow waterproof fabric formed in the shape of a human body including two arms, two legs and a torso;

(b) first and second horizontal pleats extending inwardly along front regions of each of the two legs of the dry-suit;

(c) first and second elastic waterproof fabric panels covering the respective first and second horizontal pleats and sealed with the surrounding adjacent regions of the fabric of the dry-suit; and (d) horizontal pleats located in the back region of the torso of the dry-suit.

8. A dry-suit as claimed in claim 7 including horizontal pleats located in the rear surfaces of the two legs of the dry-suit.

9. A dry suit as claimed in claim 7 including vertical pleats and covering panels.

10. A dry-suit comprising:

(a) a hollow waterproof fabric formed in the shape of a human body including two arms, two legs and a torso;

(b) first and second vertical pleats extending inwardly along the front regions of each of the two legs of the dry-suit;

(c) first and second elastic waterproof fabric panels covering the respective first and second vertical pleats and sealed with the surrounding adjacent regions of the fabric of the dry-suit; and (d) vertical pleats located in the back region of the torso of the dry-suit.

11. A dry-suit as claimed in claim 10 including vertical pleats located in the rear surfaces of the two legs of the dry-suit.

* * * * *

US006715149C1

(12) EX PARTE REEXAMINATION CERTIFICATE (5638th)

United States Patent

Myerscough

(10) Number: US 6,715,149 C1

(45) Certificate Issued: Dec. 19, 2006

(54) CAPTIVE SHELL DRY-SUIT

(75) Inventor: Richard Kerr Myerscough, Victoria (CA)

(73) Assignee: Whites Manufacturing Ltd., Saanichton (CA)

Reexamination Request:
No. 90/007,840, Dec. 8, 2005

Reexamination Certificate for:

| | |
|---|---|
| Patent No.: | **6,715,149** |
| Issued: | **Apr. 6, 2004** |
| Appl. No.: | **10/025,627** |
| Filed: | **Dec. 26, 2001** |

(51) Int. Cl.
*B63C 11/82* (2006.01)

(52) U.S. Cl. ..... 2/2.15; 2/82

(58) Field of Classification Search ..... None
See application file for complete search history.

(56) References Cited

U.S. PATENT DOCUMENTS

| | | | |
|---|---|---|---|
| 2,582,811 | A | 1/1952 | Williams |
| 4,151,612 | A | 5/1979 | Vykukal |
| 5,052,053 | A | 10/1991 | Peart |
| 5,806,090 | A | 9/1998 | Johnson |

*Primary Examiner*—Bibhu Mohanty

(57) ABSTRACT

This invention relates to a novel design of dry-suit. More particularly, this invention pertains to a novel dry-suit design which has a smooth captive shell and concealed pleats for improved dry-suit functionality. A dry-suit comprising: (a) a hollow element-proof fabric formed in the shape of a human body including two arms, two legs and a torso; (b) first and second inwardly extending pleats formed in each of the two legs; and (c) first and second elastic element-proof fabric panels covering the respective first and second pleats and sealed around the periphery with the surrounding adjacent regions of the element-proof fabric of the dry-suit.

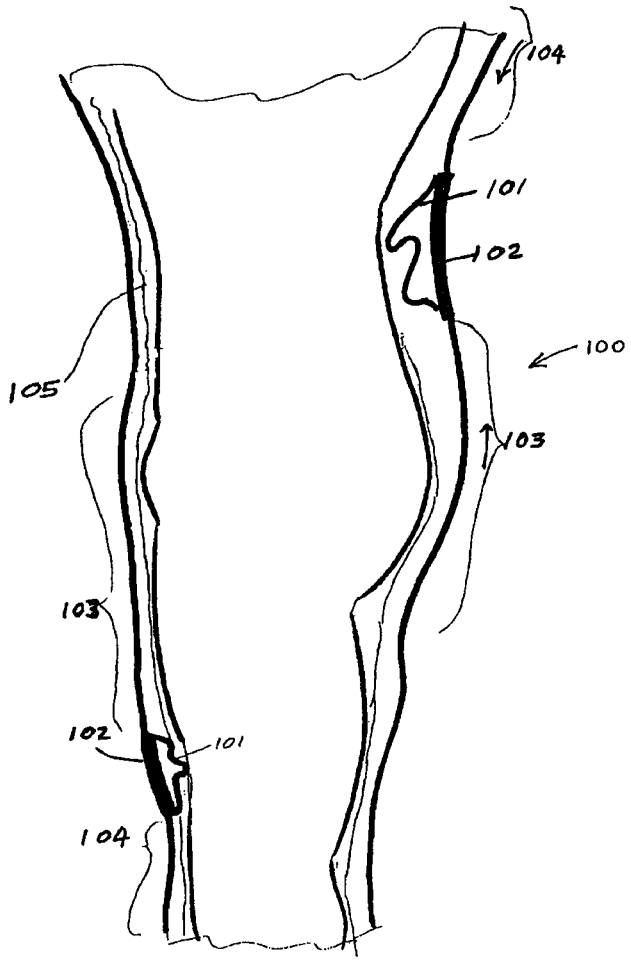

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *